United States Patent [19]

Shabala

[11] 4,222,567

[45] Sep. 16, 1980

[54] GOLF CLUB WITH LOFT ANGLE MARKINGS

[75] Inventor: Stephen Shabala, Orlando, Fla.

[73] Assignee: The John Rouzee Green Co., York, S.C.

[21] Appl. No.: 949,966

[22] Filed: Oct. 10, 1978

[51] Int. Cl.[3] ..... A63B 53/06; A63B 53/08

[52] U.S. Cl. ..... 273/167 R; 273/79; 273/77 A; 273/183 D

[58] Field of Search ..... 273/79, 164, 183 D, 273/167 R, 162 R, 77 A, 32 H, 186 A, 163 A, 163 R

[56] References Cited

U.S. PATENT DOCUMENTS

| | | | |
|---|---|---|---|
| 837,030 | 11/1906 | Blanchard | 273/164 |
| 1,126,208 | 1/1915 | Hayford | 273/163 A |
| 1,291,967 | 1/1919 | McDougal | 273/164 |
| 1,485,272 | 2/1924 | Kinsman | 273/164 |
| 1,488,900 | 4/1924 | Armstrong | 273/81 B |
| 1,603,850 | 10/1926 | Keating | 273/163 A |
| 1,604,696 | 10/1926 | Jordy | 273/164 X |
| 2,381,636 | 8/1945 | Bancroft | 273/79 |
| 2,447,967 | 8/1948 | Stone | 273/164 |
| 2,865,635 | 12/1958 | Jessen | 273/164 |
| 4,077,632 | 3/1978 | Taylor | 273/164 |

*Primary Examiner*—George J. Marlo

*Attorney, Agent, or Firm*—Richards, Shefte & Pinckney

[57] ABSTRACT

A plurality of linear sighting marks on the club face of a golf club, each mark being disposed at a different acute angle with respect to the lower edge of the club face and each mark being arranged on the club face at a location to cause the club face to assume a different angular relation to a vertical plane extending therethrough when the club head is positioned, respectively, to orient each mark in perpendicular relation to the intended line of travel of a golf ball struck by the club face, whereby the loft and distance of travel of the golf ball may be selectively varied.

5 Claims, 7 Drawing Figures

GOLF CLUB WITH LOFT ANGLE MARKINGS

BACKGROUND OF THE INVENTION

A set of golf clubs traditionally comprises a number of woods, generally a driver or No. 1 wood, a No. 2 wood, a No. 3 wood, and a No. 4 wood, and a number of irons, generally irons No. 2 through No. 9, and a wedge. Under the prevailing rules of the Professional Golfers Association, a golfer may carry no more than fourteen clubs, which limitation allows a golfer to carry each of the basic clubs enumerated above in addition to a putter. The clubs are designed with graduated loft angles, i.e. the angle between a vertical plane intersecting the club face and the planar surface of the club face, the varying loft angles allowing a golfer to selectively vary the distance of travel of a golf ball without altering his normal full swing by merely using a club with a different loft angle. The woods are designed with relatively small loft angles, and are capable of hitting a golf ball relatively longer distances than are irons, the driver having the least loft with the Nos. 2, 3, and 4 woods having progressively greater loft angles, respectively. Similarly, the loft angle of irons progressively increases as the identifying club number increases, the wedge having the greatest loft angle of any club.

Due to the differing loft angle, the distance variation between any two golf clubs in sequence (e.g. a 7 iron and an 8 iron) is approximately ten yards under normal conditions, and, therefore a full set of clubs is generally sufficient to enable a golfer to make a shot of almost any desired distance without altering his normal swing by merely selecting the club with the appropriate loft angle. Many golfers, however, do not carry a full set of clubs but instead carry a set of clubs usually referred to as a "short set", i.e. a driver, a 3 wood, irons Nos. 3, 5, 7 and 9, and a putter. For golfers carrying a short set of clubs, the variation in distances attainable from club to club are obviously significantly greater than with a full set of clubs. Additionally, even when a golfer has a full set of clubs available, the wedge is the club having the greatest loft angle and is therefore the club capable of accurately hitting a golf ball the shortest distance when a normal swing is used, generally a maximum of approximately 115 yards. Therefore, the wedge is used in attempting many shots of a distance substantially less than 115 yards, and there is a significant distance variation over which a golfer must be capable of using the wedge accurately. A very similar problem exists for those golfers who use a set of clubs, such as a short set, in which the 9 iron is the club having the greatest loft angle.

When the golfer using a short set of clubs finds himself confronted with a shot which normally would require one of the intermediate clubs which he does not have, he has three alternatives: (1) he can use the club having the next greater loft angle and attempt to strike the ball with greater force than he normally would, this alternative being the least preferable, (2) he can use the club having the next lower loft angle and attempt the shot using less than a full swing, or (3) he can use the club having the next lower loft angle, "opening" the face of the club so that the club face assumes a greater loft angle with respect to a vertical plane therethrough, and attempting the shot with a normal swing. When a golfer finds himself a shorter distance from the hole than the distance a full wedge, or 9 iron, shot will travel, he has available the second and third alternatives just described. Regardless of the choice made, it is difficult to precisely determine either the degree to which the golfer should reduce his swinging force or the degree to which he should "open" the club face in order to execute the shot properly. Even when a golfer successfully executes a shot using either of the alternative methods above, a later shot made under similar circumstances will probably not be consistent with the successful shot since the golfer has no available reference by which he can remember the degree to which he reduced his swing or opened the club face.

The present invention provides a unique, calibrated system of marking the club face of golf clubs, the markings serving as accurate references whereby the club head of any individual club may be selectively oriented with respect to the intended line of travel of the golf ball to allow selective variation of the effective loft angle of the club and, therefore, selective variation of the distance of travel of a golf ball struck by the club head. More particularly, the present invention enables a golfer using a short set of clubs to selectively and accurately orient the club head of any individual club in his set to cause the club face to effectively assume the loft angle of the next higher numbered club in the normal numbering sequence of a full set of clubs, i.e. one of the intermediate clubs not normally included in a short set of clubs. Additionally, the present invention enables a golfer, when confronted with a shot of a lesser distance than a full wedge, or a full nine iron when a wedge is not available, to selectively and accurately open the club face of his golf club a predetermined amount, causing the club face to assume a greater loft angle and permitting the golfer to make the shot by using a normal full swing.

SUMMARY OF THE INVENTION

The present invention provides a golf club having a club head presenting a club face for striking a golf ball, the club face having a lower edge, and a shaft extending upwardly from the club head. A plurality of linear sighting marks are presented on the club face, each of the marks being disposed at a different acute angle with respect to the lower edge of the club face, and each mark being arranged on the club face at a location to cause the club face to assume a different angular relation to a vertical plane extending therethrough when said club head is positioned, respectively, to orient each mark in perpendicular relation to the intended line of travel of a golf ball struck by the club face, whereby the loft and distance of travel of the struck golf ball may be selectively varied.

In accordance with the preferred embodiment of the present invention, the club face has a toe section at the extending end thereof, the aforesaid sighting marks being located on the toe section and progressively spaced from the lower edge with the acute angle between each of the marks and the lower edge increasing as the spacing thereof from the lower edge increases.

According to another feature of the invention a plurality of linear shaft marks are formed along the shaft in generally parallel relation to the shaft and to one another. Each shaft mark is arranged on the shaft at a location which will cause one of the shaft marks to be presented along the top longitudinal portion of the shaft when a corresponding one of the club face marks is oriented in perpendicular relation to the intended line of travel of the golf ball. In the preferred embodiment, each of the club face marks is a different color and each of the shaft marks is a color identical to one of the club face marks to permit the golf club to be positioned with a club face mark of one color oriented in perpendicular relation to the intended line of flight of the golf ball and with a shaft mark of an identical color located along the top longitudinal portion of the shaft.

Thus, a golfer using a short set of clubs marked according to the present invention can, when confronted with a shot requiring one of the intermediate clubs which he does not have, use the club having the next lowest loft angle and, by virtue of the reference markings thereon, selectively and accurately increase the effective loft angle thereof to correspond to the loft angle of the required intermediate club thereby enabling him to make the shot using a normal, full swing. Additionally, in any set of clubs, the wedge or the nine iron, when marked according to the present invention, enables a golfer to selectively orient the club head to accurately increase the effective loft angle thereof thereby permitting him to use a normal full swing to make shots of a distance substantially shorter than the distance a normal wedge or nine iron shot would travel.

DESCRIPTION OF THE PREFERRED EMBODIMENT

Referring now in greater detail to the accompanying drawings, the golf club marking system of the present invention is illustrated in its preferred embodiment, i.e. on a conventional pitching wedge. However, as will be explained in more detail below, it should be understood that the present invention it not limited to use on pitching wedges and can be used on any conventional golf club. It is therefore to be understood that the present invention has broad utility and is not intended to be limited to the embodiment herein illustrated and described, such illustration and description being only representative of the present invention.

Figure 1:
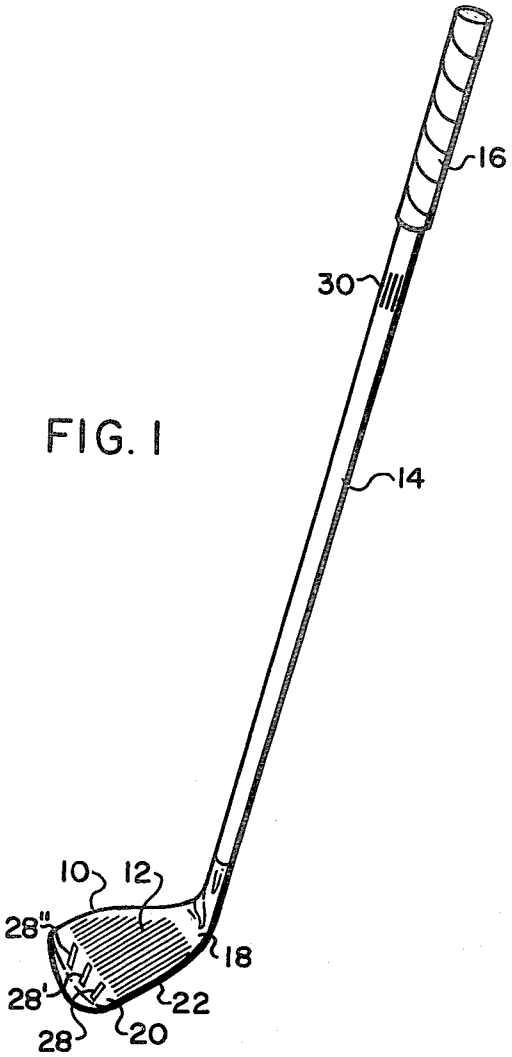
FIG. 1 is a perspective view of a pitching wedge embodying the present invention.
Figure 2:
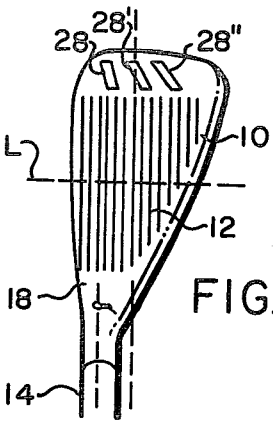
FIG. 2 is a plan view of the club head of the wedge of FIG. 1 oriented in the normal square position to address a golf ball.
Figure 3:
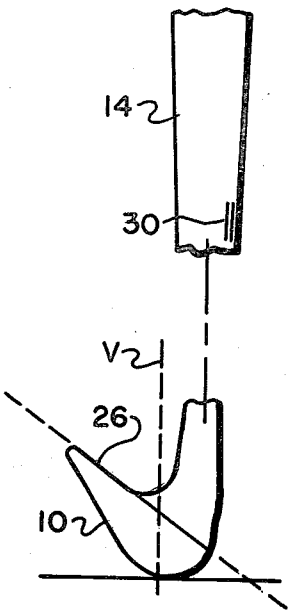
FIG. 3 is an elevational view of the club head at its FIG. 2 orientation.

As illustrated in FIG. 1, the wedge, like any conventional golf club, includes a club head 10 presenting a club face 12 for striking a golf ball. A shaft 14 extends upwardly from the club head 10 and a handle or grip 16 is provided at the upper end of the shaft 14. The club face 12 comprises a heel portion 18 adjacent the shaft 14 and a toe portion 20 at the extending end of the club face 12. In preparing to make a golf shot, the golfer normally stands beside the golf ball and orients the club face 12 directly therebehind so that the generally linear lower edge 22 thereof is perpendicular to the intended line of flight L of the golf ball, as illustrated in FIG. 2 which represents the golfer's viewpoint of the club head 10. As illustrated in FIG. 3, the loft angle of the club head 10 is determined by the angular relation between a vertical plane (represented by the reference character V in FIGS. 3, 5 and 7) oriented perpendicularly to the intended line of travel (represented by the reference character L in FIGS. 2, 4 and 6) of the golf ball and the planar surface 26 of the club face 12. By utilizing a golf club having a greater loft angle to strike the golf ball, a golfer can attain a greater loft or height of travel and decrease the distance of travel while using a normal full swing.

Figure 4:
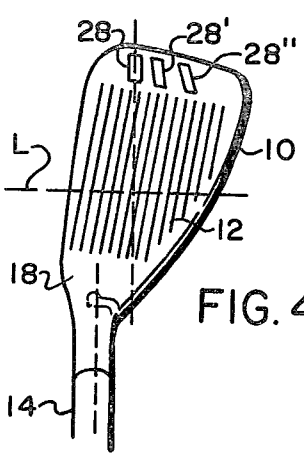
FIG. 4 is a plan view similar to FIG. 2 but illustrating the use of one of the sighting marks of the present invention to orient the club head in an opened position to increase the loft angle of the club.
Figure 5:
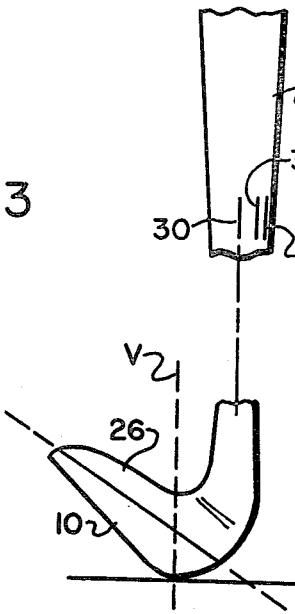
FIG. 5 is an elevational view of the club head at its FIG. 4 orientation.
Figure 6:
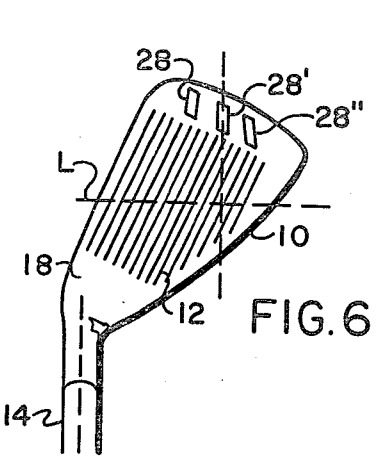
FIG. 6 is a plan view similar to FIG. 4 but illustrating the club head oriented at a more opened position using another of the sighting marks of the present invention.
Figure 7:
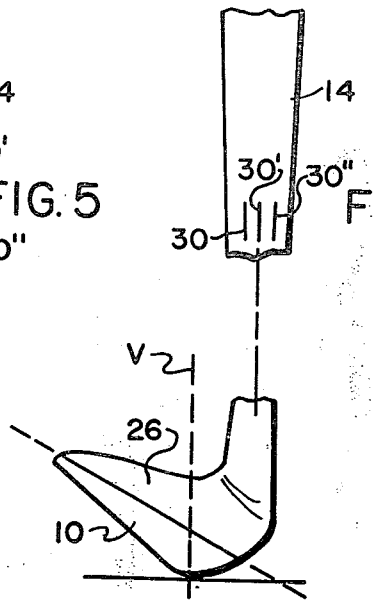
FIG. 7 is an elevational view of the club head at its FIG. 6 orientation.

As discussed above, golfers often "open" the club face 12 of the golf club when addressing the golf ball in preparation for a shot in order to vary the effective loft angle of the golf club and thereby increase the height or loft at which the struck golf ball will travel while reducing the distance of travel. In accordance with the present invention, a plurality of linear sighting marks 28, 28', 28'', each being disposed at a different acute angle with respect to the lower edge 22 of the club face 12, are arranged on the toe portion 20 thereof and are progressively spaced from the lower edge 22 with the acute angle between each mark and the lower edge 22 increasing as the spacing thereof from the lower edge 22 increases. As illustrated in FIGS. 4–7, by orienting any individual mark 28, 28', 28'', in perpendicular relation to the intended line of travel L of the golf ball when addressing the golf ball in preparation for striking it, the golfer causes the club face 12 to assume a different predetermined loft angle. In contrast to prior art golf clubs on which no visual guide is provided, a golfer utilizing the present invention can accurately and selectively vary the loft angle of the club, thereby enabling him to more accurately predict the distance the golf ball will travel when opening the club face 12. For example, in the embodiment illustrated in which three sighting marks 28, 28', 28'', are provided on an otherwise conventional wedge, the golfer has available four different loft angles, any one of which he may use to selectively and predictably vary the distance a struck golf ball will travel. As illustrated in FIGS. 4 and 5, a moderate opening of the club face 12 is achieved by manipulating the wedge to orient the mark 28 in perpendicular relation to the intended line of flight L of the golf ball, thereby slightly increasing the effective loft angle of the club and correspondingly reducing the distance of travel of a struck golf ball. A greater reduction in the distance of travel of the golf ball may be effected by manipulating the wedge to orient the mark 28' in perpendicular relation to the intended line of flight L of the golf ball, as illustrated in FIGS. 6 and 7. The orientation of mark 28'' perpendicularly to the intended line of flight L of the golf ball effects the largest loft angle and the most severe opening of the club face 12.

As will be understood by one skilled in the art, the aforementioned technique of opening the club face 12 of a golf club to increase the effective loft angle of the club necessarily involves the turning of the club shaft 14 also. Therefore, as illustrated in FIG. 1, the wedge may also be provided with a respective plurality of linear shaft marks 30, 30', 30'' formed along the shaft 14 in generally parallel relation to the shaft 14 and to one another. Each shaft mark 30, 30', and 30'', corresponds to one of the club face marks 28, 28', 28'', and each shaft mark 30, 30', 30'', is arranged on the shaft at a location which will cause one of the shaft marks 30, 30′, 30″, to be presented along the top longitudinal portion of the shaft 14 when the corresponding one of the club face marks 28, 28′, 28″, is oriented perpendicularly to the intended line of flight L of the golf ball. That is, when a selected club face mark 28, 28′, or 28″, is properly oriented perpendicularly to the intended line of flight of the golf ball, a corresponding shaft mark 30, 30′, 30″, will appear on the top or upwardly facing longitudinal portion of the club shaft 14 which is visible to the golfer when addressing the golf ball in preparation for the shot and will directly coincide with the golfer's line of sight of the golf ball, as illustrated in FIGS. 3, 5, and 7. Thus, as illustrated in FIGS. 4 and 5, when the club face mark 28 is properly oriented perpendicularly to the intended line of travel L of the golf ball (FIG. 4), the shaft mark 30 will necessarily be oriented on the top longitudinal portion of the shaft 14 directly coinciding with the golfer's line of sight of the golf ball (FIG. 5). Similarly, as illustrated in FIGS. 6 and 7, the orientation of club face mark 28′ in perpendicular relation to the intended line of travel L of the golf ball (FIG. 6) causes the shaft mark 30′ to become oriented along the top longitudinal portion of the shaft 14 (FIG. 7). Necessarily the reverse of the above is also true, i.e. the proper orientation of a selected shaft mark on the top longitudinal portion of the shaft will cause the corresponding club face mark to be oriented in perpendicular relation to the intended line of travel of the golf ball.

Thus, the shaft marks 30, 30′, 30″, function as an additional reference source by which to gauge the opening of the club face 12 when desired and which can be used either alternately or conjunctively with the club face marks 28, 28′, 28″. To facilitate the aforesaid conjunctive use, each club face mark 28, 28′, 28″, is formed of a different color, and each shaft mark 30, 30′, 30″, is formed of a color identical to the color of the club face mark 28, 28′, 28″ to which it corresponds, thereby permitting the golf club to be positioned so that when a selected club face mark 28, 28′, 28″ of one color is oriented in perpendicular relation to the intended line of travel L of the golf ball, a shaft mark 30, 30′, 30″, of the identical color will be located along the top longitudinal portion of the shaft 14.

In the illustrated embodiment of the present invention, three sighting marks are used to provide the golfer with a suitable variety of loft angle adjustments for a wedge. A typical loft angle of a conventional pitching wedge when oriented in the normal square position shown in FIG. 3 is 52°. It is preferred that, in an embodiment utilizing three club face marks and three corresponding shaft marks, the mark 28 (i.e. the mark forming the most acute angle with the lower edge 22 of the club face) be oriented on the club face 12 in a position such that, when the club head 10 is manipulated to orient the club face mark 28 in perpendicular relation to the intended line of travel L of the golf ball, the club face 12 assumes a loft angle of 61°, the effect of which will be to reduce the distance of travel of a golf ball struck thereby by approximately 25% of the distance of a normal full wedge shot. The mark 28′ is located on the club face 12 at a different angle with respect to the lower edge 22 of the club face 12 so that, when mark 28′ is oriented perpendicularly to the intended line of travel L of the golf ball, the loft angle of the club face increases to 70°, the effect of which is to reduce the distance a golf ball struck thereby will travel by approximately 50%. Similarly, the mark 28″ is positioned on the club face 12 so that the orientation thereof perpendicularly to the intended line of travel of the golf ball will cause the club face 12 to assume a loft angle greater than 70°, the effect of which is to reduce further the distance of travel of a golf ball struck thereby. The shaft marks 30, 30′, and 30″, should be positioned on the shaft accordingly.

As noted above, the sighting marks of the present invention are also particularly useful when placed on each club in a short set of clubs to enable the golfer using any of the clubs in such set to manipulate the club head 10 to orient the club face 12 so that it assumes the loft angle of the next higher club in the normal numbering sequence of a full set of clubs, thereby permitting the golfer to compensate for the intermediate clubs not included in a short set. It is contemplated that the provision of one, or possibly two, sighting marks on each of the club face and club shaft of each club in a short set of clubs will be sufficient to enable the golfer using the set of clubs to accurately make any shot which normally would require one of the intermediate clubs which he does not have.

When a golfer utilizes the sighting marks 28—28″, it will be appreciated that the golf club itself will be manipulated, as described above, to open the face of the golf club, and the golfer will also normally adjust, or open, his stance to compensate for the opened club face, whereby the golf ball will, when struck by the golf club, travel in its intended direction.

It is to be understood that, the particular angular relationship of the club face marks 28, 28′, 28″, with respect to the lower edge 22 of the club face 12 and the particular number of club face and shaft marks set forth above are merely illustrative of the present invention. The present invention may be embodied in any conventional golf club, and any suitable number of sighting marks may be used thereon to permit the orientation of the club face thereof at any desired loft angle greater than the normal loft angle of the club, all without departing from the intent and shape of the present invention. Similarly, it is to be understood that other modifications and variations may be resorted to without departing from the substance and scope of the present invention, as those skilled in the art will readily understand. Such alternate modifications and variations are within the scope of the present invention which is intended to be limited only by the appended claims and equivalents thereof.

I claim:

1. In a golf club having a club head presenting a club face for striking a golf ball, said club face having a lower edge, and a shaft extending upwardly from the club head, the improvement comprising a plurality of linear sighting marks located on said club face, each said mark extending toward said shaft in an upward direction with respect to said lower edge of said club face and at a different preselected acute angle with respect to said lower edge of said club face, and each said mark being arranged on said club face at a location to cause said club face to assume a greater angular relation to a vertical plane extending therethrough when said club head is positioned, respectively, to orient each said mark in perpendicular relation to the intended line of travel of a golf ball struck by said club face, whereby the loft and distance of travel of said struck golf ball may be selectively varied.

2. The improvement defined in claim 1 and characterized further in that said club face has a toe section at the extending end thereof, and in that said marks are located on said toe section.

3. The improvement defined in claim 2 and characterized further in that said marks are progressively spaced from said lower edge with said acute angle between each said mark and said lower edge increasing as the spacing thereof from said lower edge increases.

4. The improvement defined in claim 1 and characterized further by a plurality of linear shaft marks being formed along said shaft in generally parallel relation to said shaft and to one another, each said shaft mark being arranged on said shaft at a location which will cause one of said shaft marks to be presented along the top longitudinal portion of said shaft when a corresponding one of said club face marks is oriented in perpendicular relation to said intended line of travel of said golf ball.

5. The improvement defined in claim 4 and characterized further in that each said club face mark is a different color and in that each said shaft mark is a color identical to the color of one of said club face marks to permit said golf club to be positioned with a club face mark of one color oriented in perpendicular relation to said intended line of travel of the golf ball and with a shaft mark of an identical color located along the top longitudinal portion of said shaft.

* * * * *